US009664134B2

(12) United States Patent
Remele et al.

(10) Patent No.: US 9,664,134 B2
(45) Date of Patent: May 30, 2017

(54) METHOD FOR ADJUSTING AN INJECTION BEHAVIOR OF INJECTORS IN AN INTERNAL COMBUSTION ENGINE, ENGINE CONTROL UNIT AND SYSTEM FOR ADJUSTING AN INJECTION BEHAVIOR

(71) Applicant: MTU Friedrichshafen GmbH, Friedrichshafen (DE)

(72) Inventors: Jörg Remele, Hagnau (DE); Aron Toth, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 265 days.

(21) Appl. No.: 14/683,636

(22) Filed: Apr. 10, 2015

(65) Prior Publication Data

US 2015/0211430 A1 Jul. 30, 2015

Related U.S. Application Data

(63) Continuation of application No. PCT/EP2013/002995, filed on Oct. 4, 2013.

(30) Foreign Application Priority Data

Oct. 10, 2012 (DE) ..... 10 2012 020 489

(51) Int. Cl.
*F02D 41/00* (2006.01)
*F02D 41/26* (2006.01)
(Continued)

(52) U.S. Cl.
CPC ..... *F02D 41/263* (2013.01); *F02D 41/009* (2013.01); *F02D 41/0085* (2013.01);
(Continued)

(58) Field of Classification Search
CPC ..... F02D 41/0085; F02M 65/001
(Continued)

(56) References Cited

U.S. PATENT DOCUMENTS 4,718,015 A 1/1988 Grob et al.
5,131,371 A 7/1992 Wahl et al.
(Continued)

FOREIGN PATENT DOCUMENTS

DE 100 55 192 A1 5/2002
DE 10 2005 047 829 B3 5/2007
DE 10 2009 045 374 A1 4/2011

OTHER PUBLICATIONS

International Search Report dated Feb. 6, 2014 for International Application No. PCT/EP2013/002995 (6 pages).

*Primary Examiner* — Erick Solis
(74) *Attorney, Agent, or Firm* — Taylor IP, P.C.

(57) ABSTRACT

The invention relates to a method for adjusting an injection behavior of injectors in an internal combustion engine, including the following steps: switching off an injector; detecting a crank angle signal of the internal combustion engine; transforming the crank angle signal into the frequency range by way of a discrete Fourier transformation; detecting and storing a quantity of the harmonic of the 0.5th order of the Fourier transform of the crank angle signal, and assigning the quantity to the switched-off injector; switching on the switched-off injector; performing the previous steps sequentially for all injectors of the internal combustion engine; forming an average value of the stored quantities with respect to all injectors, and correcting the control of the injectors using a deviation from the average value of a quantity associated with an injector that is to be corrected.

11 Claims, 1 Drawing Sheet

(51) Int. Cl.

| | |
|---|---|
| ***F02M 65/00*** | (2006.01) |
| ***F02D 41/24*** | (2006.01) |
| ***F02D 41/04*** | (2006.01) |
| ***F02D 41/30*** | (2006.01) |
| *F02D 41/28* | (2006.01) |

(52) U.S. Cl.
CPC ..... *F02D 41/04* (2013.01); *F02D 41/2438* (2013.01); *F02D 41/30* (2013.01); *F02M 65/001* (2013.01); *F02D 41/0087* (2013.01); *F02D 41/2467* (2013.01); *F02D 2041/288* (2013.01)

(58) Field of Classification Search
USPC ..... 123/436, 673, 674; 73/114.48
See application file for complete search history.

(56) References Cited

U.S. PATENT DOCUMENTS

| | | | | |
|---|---|---|---|---|
| 6,021,758 | A | 2/2000 | Carey et al. | |
| 7,219,003 | B2 | 5/2007 | Hagel et al. | |
| 8,036,811 | B2 * | 10/2011 | De Fazio | F02D 41/1497 701/103 |
| 9,046,048 | B2 * | 6/2015 | Malaczynski | F02D 45/00 |
| 9,279,378 | B2 * | 3/2016 | Katayama | F02D 41/0085 |
| 2002/0148441 | A1 * | 10/2002 | Tuken | F02D 41/0085 123/436 |
| 2003/0089338 | A1 * | 5/2003 | Remele | F02D 41/0085 123/436 |
| 2010/0063711 | A1 | 3/2010 | Hagel et al. | |

* cited by examiner

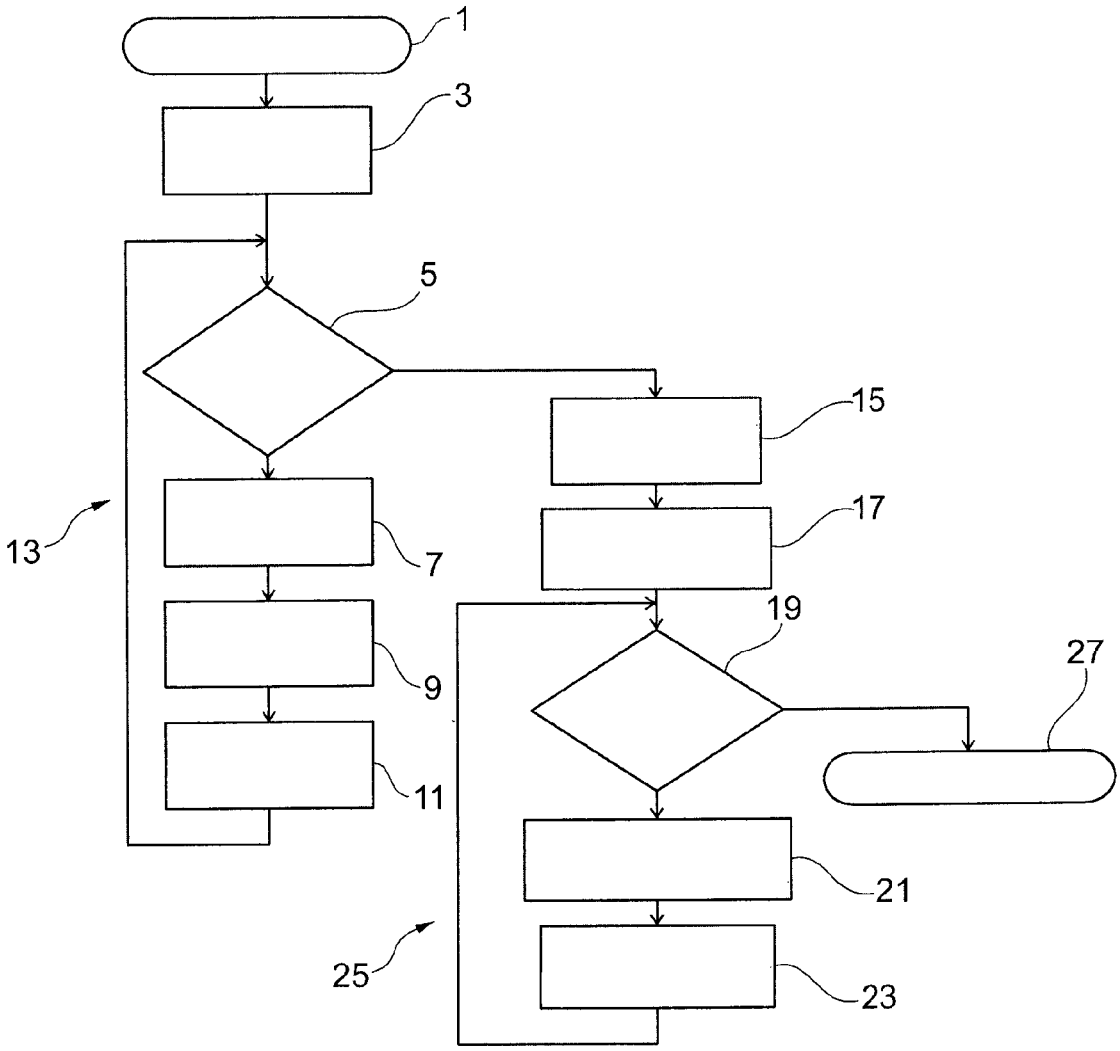
1
3
5
15
17
13
7
19
27
9
11
21
25
23

METHOD FOR ADJUSTING AN INJECTION BEHAVIOR OF INJECTORS IN AN INTERNAL COMBUSTION ENGINE, ENGINE CONTROL UNIT AND SYSTEM FOR ADJUSTING AN INJECTION BEHAVIOR

CROSS REFERENCE TO RELATED APPLICATIONS

This is a continuation of PCT application No. PCT/EP2013/002995, entitled "METHOD FOR ADJUSTING AN INJECTION BEHAVIOR OF INJECTORS IN AN INTERNAL COMBUSTION ENGINE, ENGINE CONTROL UNIT AND SYSTEM FOR ADJUSTING AN INJECTION BEHAVIOR", filed Oct. 4, 2013, which is incorporated herein by reference.

BACKGROUND OF THE INVENTION

1. Field of the Invention

The invention relates to a method for adjusting an injection behavior of injectors in an internal combustion engine, an engine control unit implementing the method, as well as a system for adjusting an injection behavior of injectors.

2. Description of the Related Art

Methods for adjusting an injection behavior of injectors in an internal combustion engine are known. These prior art methods share on underlying problem in that injectors for injecting fuel into cylinders of the internal combustion engine having identical control, in particular for energizing, display manufacturing-related variances in their opening behavior. If therefore, injectors of an internal combustion engine with identical flow-parameters, in particular with an identical flow-duration are controlled in the same way, they nevertheless inject different fuel amounts into the individual cylinders. With small injection amounts the variance is so significant that some injectors inject fuel into the cylinders that are allocated to them while others do not open. Pre-injection and after-injection are therefore not feasible if the injectors vary strongly. It is therefore desirable to reduce the variance of the injectors upon opening if possible, in order to improve the operation of the internal combustion engine.

German Disclosure document DE 100 55 192 A1 discloses a method for concentricity control for diesel engines with the assistance of which corrective factors for injection amounts are achieved for equalization of the individual cylinders in regard to their rotational speed proportions. This reference discloses determination of a one-time impulse response spectrum for each cylinder, whereby the cylinders are turned off individually in succession, and whereby the rotational speed is recorded above the crank angle. Moreover, the rotational speed progression of the healthy engine, that is when all cylinders operate normally, is measured. By calculating the difference of the curve progression of the healthy engine and the curve progressions for individually turned off cylinders, new curves are created which reflect the influence of each cylinder on the overall rotational speed progression. These response curves are subjected to a Fourier factorization analysis. Then the low frequency oscillations, in particular of the $0.05^{th}$ to third order are considered, and associated spectral impulse responses of the individual cylinders and the individual orders of the harmonic component are captured in a matrix. During operation of the engine the rotational speed progression of the crankshaft is continuously plotted over the angle and Fourier transformed. The Fourier coefficients, preferably those of the low frequency oscillations, in particular of the harmonic component of the $0.05^{th}$ to third order are summarized as a vector. Correction values for the injectors are determined in that the thus obtained vector, and is subject to a scalar multiplication with the matrix representing the impulse responses.

The present inventors found that the method of the aforementioned reference was substantially based on the assumption that the basis vectors assigned to the harmonic components of the Fourier transformation are linearly independent of each other, so that they form an orthogonal basis of a vector space. Practical experience showed however, that this assumption is not applicable, whereby the applicable vectors are positioned at least partially collinear or at least not orthogonal relative to each other. The method of the aforementioned reference can therefore not be implemented reliably with the desired results.

What is needed in the art is a method which safely and efficiently provides injector equalization, so that a series variance can be compensated for. The method must be to be simple and cost effective and should be accomplished during running operation of the internal combustion engine. It is further needed in the art to provide an engine control unit with the assistance of which the method can be implemented. Finally, a system is needed with which the injection behavior of injectors in an internal combustion engine may be adjusted.

SUMMARY OF THE INVENTION

The present invention provides a method that meets the needs identified above. Accordingly, following the start of the method a first injector is initially turned off. A crank angle signal from the internal combustion engine is detected and transformed into the frequency range by way of discrete Fourier transformation. From the discrete Fourier transformation results in particular an amount and an angle of the harmonic of the $0.05^{th}$ order, whereby only the amount is captured and stored. The amount is assigned to the only injector that is turned off during the capture. Afterwards the turned off injector is again turned on. These steps are implemented sequentially one after another for all injectors of the internal combustion engine, so that during each step only one injector is turned off. The amounts captured in the various steps are therefore always clearly assignable to one turned off injector. After an amount of the harmonic of the $0.05^{th}$ order of the Fourier transformation of the crank angle signals has been captured, stored and assigned for each injector of the internal combustion engine, a mean value of the stored amounts is created for all injectors. In other words, all of the stored amounts assigned to the individual injectors are averaged. Control of the injectors is now corrected on the basis of a deviation from the mean value of the amount assigned to an injector that is to be corrected. This means that for each injector a difference between the amount assigned to it and the mean value is calculated, whereby this difference or deviation represents a measure for the correction of the control of the injector.

In this way a type of regression to the mean value is implemented for all injectors. Their injection behavior is thus adjusted so that the measured amount of the harmonic of the $0.5^{th}$ order of the Fourier transformation of the crank signal is approximated to the mean value of all injectors. In contrast to the known method, an impulse response spectrum or respectively an impulse response matrix is not determined only once, wherein the correction during running engine operation is then calculated with the impulse response matrix exclusively via the creation of a scalar product of the currently measured values of different order from the Fourier spectrum of the crank angle signal. Rather, a comparison of the injection behavior of the individual injectors by way of the amount of the harmonic of the $5^{th}$ order with an average injection behavior is continuously performed. Because of this continuously performed individual comparison while turning off individual injectors with the actual mean value, it is possible to forgo having to consider contributions of a higher order and to limit analysis to the $0.5^{th}$ order. The characteristic of the higher harmonic, not to span an orthogonal vector space is no longer relevant because of this. A precise adjustment of the injector performance of the individual injectors is possible, so that all injectors inject approximately the same amount of fuel. It becomes also possible to achieve a pre-injection and/or an after-injection. A pre-injection is advantageous because a softer combustion sequence, as well as a reduction of the nitrogen oxide formation is thereby feasible. An after-injection leads to a temperature increase of the exhaust gas, which is advantageous for downstream exhaust gas treatment.

The method may be implemented by way of an engine control unit, whereby the crank angle signal, in other words a rotational speed progression of the crank shaft over the crank angle, is detected by a crank shaft sensor and transmitted to the engine control unit. A crankshaft sensor is always provided in modern internal combustion engines, and an engine control unit is also included. To implement the method, therefore, only components that are included anyhow in the internal combustion engine are used. Therefore, no additional costs occur in the implementation of the method for sensors, devices and/or wiring. The algorithm for execution of the method may be implemented within the engine control unit.

The engine control unit may be synchronized through the signal of a cam shaft sensor to operating cycles of the cylinder of the internal combustion engine. This can occur one single time after or during the start of the internal combustion engine, or can occur continuously. A cam shaft sensor is also normally included in an internal combustion engine, and synchronization of the engine control unit with the operating cycles of the cylinders also occurs in normal engine control. In this respect, no additional expenditure is required to implement the method.

The method may only correct an injector if the deviation of the detected and stored amount of the harmonic of the $0.5^{th}$ order of the Fourier transformation of the crank angle signal exceeds a predetermined threshold value which was determined from a mean value of all injectors. This approach is based on the concept that not every small deviation from the mean value is relevant in practice. Therefore, in order to keep the injector equalization efficient, a threshold value can meaningfully be determined, whereby if said threshold value is exceeded by a deviation that is assigned to one injector, a correction actually occurs. Therefore, it is first determined for each injector if the deviation exceeds the predetermined threshold value and only if this is the case the correction in controlling this injector is in fact implemented.

The method may calculate for each injector a differential amount as a difference from the amount assigned to the injector which is detected and stored when all injectors are turned on, whereby the differential amounts assigned to the individual injectors are used as basis for averaging and also for the correction. This approach is based on the concept that the amount of the harmonic of the $0.5^{th}$ order of the Fourier transformation of the crank angle signal, in the event that all injectors are turned on, and the internal combustion engine is therefore operating normally, does not necessarily disappear or at least may only be near zero. If an amount that is clearly different from zero can be detected for the normally operating internal combustion engine, all amounts measured for the individual turned off injectors may be referenced to this amount, in that their differences from this amount are calculated and considered for the further process. Moreover, the creation of a mean value relates then to the thus calculated differential amounts and the correction in the control of the injectors is implemented accordingly on the basis of the deviations of the differential amounts from this created mean value. The differences are hereby typically signed, in other words no absolute values in a strict mathematical sense.

It is thereby possible that the amount serving as reference point for the amounts assigned to the individual injectors is measured during normal operation of the internal combustion engine, and is captured and stored once, for example after a start of the internal combustion engine. It is however also possible to capture and store this amount in predetermined time intervals or continuously when no injector is turned off. In such a case, a value stored in a data base may be continuously replaced by a current, newly captured value.

It may be that the method is not implemented on the basis of absolute amounts, but rather on the basis of the differential amounts relative to the amount of the harmonic of the $0.5^{th}$ order of the normal running engine which serves as the reference point if this amount, in other words the reference point, is different from zero, at least in the relevant extent. If this is not the case, and the amount is zero or at least near zero, the method can be implemented on the basis of the absolute amounts that were collected and stored for the injectors, without creating differentials. It is however possible to implement the method in this case on the basis of the differential amounts, in particular since there is no difference in the result compared with the method without difference creation if the amount is zero with a normally running engine. The differences are after all "amounts".

The method may conduct multiple iterations. The method may further be iterated, in other words conducted sequentially one after another, until the deviation of each injector from the mean value created for each injector no longer exceeds the predetermined threshold value. The method may be repeated until the deviation from the mean value for all injectors is less than the predetermined threshold value. This ensures that, at least to a practically relevant extent, that in fact all injectors inject substantially the same fuel amount. A practical relevant range can be determined by definition of the predetermined threshold values.

The method may provide that control of the injectors is corrected in such a way that during the correction an overall performance of the internal combustion engine is not changed. This means that the injectors are corrected to compensate for each other. If the amount of fuel injected by a first injector is increased, then the amount of fuel injected by a second injector, or also the amount of fuel injected by several other injectors may accordingly be reduced, so that altogether the overall performance of the internal combustion engine is not changed. The injector equalization which is conducted with the help of the method therefore, may not lead to a change of the current load point of the internal combustion engine. The method particularly avoids sudden accelerations or decelerations of the internal combustion engine. It is thereby possible that this characteristic is further ensured outside of the method in that for example a torque control is superimposed over the method. It is however also possible to provide this characteristic within the method by considering such compensation inherently necessary during the correction of the control of the individual injectors.

A method is moreover provided in which control of the injectors is corrected, in that an energizing duration for same is adjusted. The energizing duration of an individual injector is thereby changed so that the desired correction of the injected fuel amount is achieved. The energizing duration may for example be extended if the injector is to inject more fuel. It can be shortened, if the injector is to inject less fuel.

A method is also provided in which the energizing duration for an injector is adjusted in that an energizing duration differential is added onto the current energizing duration which is calculated according to the following equation:

$$\Delta BD[i]=(MW\Delta\text{amount}[i])K \quad (1)$$

i is hereby a running variable which runs across the individual injectors and whose value always indicates an actual observed injector. ΔBD[i] signifies the energizing duration difference which is to be added onto the actual energizing duration for injector i. This means adding the positive or negative energizing duration difference to the actual current energizing duration. MW is the mean value which is calculated from the differential amounts of the amounts of the harmonic of the $0.5^{th}$ order that are assigned to the individual injectors of the normally operating engine, in other words from the captured and stored amounts when all injectors are turned on. Δamount[i] is the accordingly determined differential amount for injector i. MW is the mean value, in other words the value formed from the individual differential amounts Δamount[i] of all injectors. K is a constant which is selected so that a suitable correction of the energizing duration is possible.

It may be ensured during the correction of the energizing duration that the overall performance of the internal combustion engine is not changed during the correction. This is ensured in that the specified equation (1) is applied preferably under the following conditions.

$$\Sigma\Delta BD[i]=0 \quad (2)$$

Σ is hereby the summation symbol and the running variable i applies to all injectors. During calculation of the energizing duration for the individual injectors it is to be ensured that their sum over all injectors always results in 0. If therefore, certain energizing durations are increased, then other energizing durations must be accordingly decreased, so that overall the summation condition remains fulfilled and the individual energizing differences cancel each other out.

Constant K is selected possibly dependent upon a current load point of the internal combustion engine. A table with the values for constant K that are assigned to various load points of the internal combustion engine may be stored in a memory of the engine control unit. Depending on the current load point of the internal combustion engine, the appropriate value for constant K is then used for implementation of the method.

The method may be performed at an operating point of the internal combustion engine wherein it operates under load or no-load. The method is in particular readily applicable under such operating conditions. With larger engines, for example engines that drive generators, engines for diesel locomotives or ships, or similar, in particular multi-cylinder large engines, a thrust phase as is known from the operation of a conventional motor vehicle generally does not exist. In this instance the term "thrust phase" is understood to be an operational condition of the internal combustion engine wherein it is dragged along by a rolling vehicle. Large engines in contrast operate only under load or no-load. Diverse methods are known whose functionality in regard to injector equalization and/or torque control is based on implementation during a thrust phase of a motor vehicle. Accordingly, these methods are not applicable for large engines where there is generally no thrust phase. Therefore, the herein proposed method is especially suitable for large engines. The special suitability of the method for large engines results from that it can readily be performed at an operating point of the internal combustion engine under load or in neutral.

The invention may also include an engine control unit for an internal combustion engine configured to perform the method according to one of the previously described embodiments. This means in particular that an algorithm to perform the method is implemented within the engine control unit. Moreover, a connection of a crankshaft sensor to the engine control unit may be provided, so that the crankshaft sensor can detect and further process a crank angle signal according to the method. Moreover, interfaces are advantageously provided on the engine control unit for connection to the individual injectors of the internal combustion engine, so that they can be energized as well as individually turned on and off by the engine control unit.

The invention further provides a system for adjustment of an injection behavior of injectors that serves in particular to implement a method according to one of the previously described embodiments. The system includes a switching device, with the assistance of which the individual injectors can be turned on and off selectively. It moreover includes a detection device which is designed so that a crank shaft angle signal of the internal combustion engine can be captured. The detection device may be designed as a crank shaft sensor. The detection device is operatively connected with a converter, so that the crank angle signal that is captured by the detection device can be transmitted to the converter. The converter is designed so that with its assistance the crank angle signal can be transformed into the frequency range by way of discrete Fourier transformation. A memory device is also provided so that with its assistance an amount of the harmonic of the $0.5^{th}$ order of the Fourier transformation of the crank angle signal can be captured and stored. For this purpose the converter and the memory device may be operatively connected. The memory device is moreover designed so that it can assign the captured and stored amount to an injector that was turned off during capturing and saving of the amount. Moreover, an averaging element is provided which is designed so that with its assistance a mean value for all injectors of the amounts stored in the memory device can be calculated. In addition a correction element is provided that is designed so that with its assistance a deviation from the mean value of an amount assigned to an injector that is to be corrected can be calculated, whereby control of the injector by way of the calculated deviation can be corrected.

The system may include an engine control unit, in particular an engine control unit according to the previously described embodiment. The engine control unit may include the switching device, the converter, the memory device, the averaging element, and the correction element.

A system is provided, which may also be included in the engine control unit, incorporating the creation of differentials by way of which for each injector a differential amount can be calculated as a difference between the amount assigned to one injector and an amount which is captured and stored when all injectors are turned on. Of course, a detection and memory device may also be provided for the amount which is captured and stored when the engine is running normally. In this case, the system may be designed so that the differential amounts assigned to the individual injectors are based on the mean value creation and the correction.

Also in other respects, the system may be designed so that the embodiments described as within the scope of the method can be implemented by the system. The system is in particular designed that the energizing duration for the injectors can be adjusted through the energizing differentials, which are calculated according to the previously described equation (1), whereby the previously described condition (2) can at the same time be maintained, in order to ensure that the overall performance of the internal combustion engine is not changed by the injector equalization. Appropriate ways for implementing the adjustment of the energizing duration according to the specified equation (1) and according to the specified conditions (2) may be provided in the engine control unit.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

FIG. 1 illustrates a flow chart which shows one embodiment of the method for injector equalization.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Referring now to FIG. 1, the method starts in step 1, after which in step 3 a number of the cylinders of the internal combustion engine is initially identified. The embodiment of the method illustrated in the drawing provides that exactly one injector is assigned to each cylinder. Therefore, the number of cylinders is consistent with the number of injectors. It is nevertheless possible in another embodiment of the method that the internal combustion engine includes more than one injector per cylinder. In this case, the number of injectors may be identified in step 3, not the number of cylinders. In step 3 a running variable i is also defined and initialized, whereby it may be assigned value of 0.

In a retrieval step 5 the current value of the running variable i is compared with the number of cylinders that are identified in step 3. For the sake of illustration, it is assumed that the running variable is initialized with a value of 0, so that value 0 of running variable i is also assigned to the first injector for which the method is performed. In another embodiment, the running variable may be initialized with another value, for example value 1. Accordingly, in retrieval step 5, if running variable i is initialized with value 0, it is verified whether the value of the running variable is less than the number of cylinders identified in step 3. If this is the case, the method proceeds to a step 7 where the injector to which the current value of running variable i is assigned is turned off.

Subsequently in a step 9 an amount or differential amount of the harmonic of the $0.5^{th}$ order of the Fourier transformation of the crank angle signal is captured and stored and assigned to the turned off injector. In a step 11 the value of running variable i is increased by one. At the same time the turned off injector is turned on again. The method returns then to retrieval step 5 where it is again verified whether the now current value of running variable i is still less than the number of cylinders. In this manner a loop 13 is cycled a number of times until an amount or differential amount has been captured for all injectors in step 9, sequentially one after the other. A value of running variable i that is consistent with the number of cylinders reduced by one is thereby assigned to the last injector. Therefore, after capture of the amount or differential amount for the last injector in step 9, the value of the running variable is increased to a value which is consistent with the number of cylinders. If this is detected in retrieval step 5 the method proceeds on to step 15.

Here, the value of running variable i is again initialized, and in particular with the herein discussed embodiment of the method set to 0. In a subsequent step 17 a mean value is created from the captured and stored amounts or differential amounts for the individual injectors. The method subsequently enters into retrieval step 19 where it is again verified whether the actual value of running variable i is less than the number of cylinders identified in step 3. If this is the case the method proceeds to step 21 where a correction in the control of the injector to which the current value of running variable i is assigned is performed. This may occur on the basis of a differential amount relating to an amount determined for the normal operation of the internal combustion engine assigned to the only turned off injector, as well as on the basis of a mean value of the differential amounts for the individual injectors. An energizing duration for the injector may be adjusted, whereby an energizing duration difference is added to the actual current energizing duration. The energizing duration difference may thereby calculated according to the aforementioned equation (1), and applied according to the aforementioned condition (2).

In subsequent step 23 the value of running variable i is again increased by one. The method then reverts to retrieval step 19, so that a loop 25 is realized. This loop is again cycled through until a correction has been performed for all injectors, or respectively until the value of running variable i in retrieval step 19 is consistent for the first time with the number of cylinders identified in step 3. This is because in the selected embodiment of the method, wherein running variable i is initialized with 0, a value is assigned to the last injector that is to be corrected which, compared to the number of cylinders is reduced by one. If, in retrieval step 19 the value of running variable i is for the first time identical to the number of cylinders identified in step 3, then the method concludes in a step 27. The correction of the energizing duration in step 21 for the cylinder to which the current value of running variable i is assigned may only be performed if a deviation of the amount or a differential amount from the median value exceeds a predetermined threshold value. Otherwise no correction for the injector is performed and the method proceeds to step 23.

The process may be iterated, in other words returns, if applicable after a predefined waiting period, from step 27 to step 1, wherein this iteration or respectively a loop provided between steps 27 and 1 which is not shown in the drawing is cycled until the deviations of the individual amounts or differential amounts for the individual injectors from the mean value are smaller than a predefined threshold value. It is hereby possible that this threshold value is identical to the threshold value which is selected for the decision whether a correction of an individual injector is to be performed. It is however also possible, as a condition to stop iteration of the entire process, to provide a threshold value that deviates from this threshold value which can be larger or smaller than the threshold value for the correction of the individual injectors.

Overall it is shown that with the assistance of the method for injector equalization, a very precise equalization of injectors, in particular in larger engines and especially during running operation under load or no-load operation is readily possible, so that the individual injectors inject substantially the same amount of fuel. For this reason pre-injection and/or after-injection are also possible in the internal combustion engine.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for adjusting an injection behavior of injectors in an internal combustion engine, including the steps of:

turning off one injector;

capturing a crank angle signal of the internal combustion engine;

transforming said crank angle signal into a frequency range by way of a discrete Fourier transformation;

capturing and storing an amount of a harmonic of the $0.5^{th}$ order of said Fourier transformation of said crank angle signal;

assigning said amount to said turned off injector;

turning on said turned off injector;

performing the previous steps in a sequential manner for each injector of the internal combustion engine;

creating a mean value of said stored amounts assigned to said injectors; and correcting a control of each said injector based on a deviation of said amount assigned to each said injector from said mean value.

2. The method according to claim 1, wherein:

said control is corrected for each said injector only if said deviation exceeds a predetermined threshold value.

3. The method according to claim 1, further including the steps of:

calculating for each said injector a differential amount as a difference between said amount of said harmonic of the $0.5^{th}$ order of said Fourier transformation of said crank angle signal captured when said injector is turned off and an amount which is detected and stored when all said injectors are turned on; and using said differential amounts as a basis for creating said mean value and as a basis for said correction.

4. The method according to claim 3, wherein:

said correction step includes adjusting an energizing duration of each said injector.

5. The method according to claim 4, wherein:

said adjustment of said energizing duration for each said injector includes an energizing duration differential being added to a current energizing duration, said energizing duration differential being calculated according to the following formula:

$$\Delta BD[i]=(MW-\Delta\text{amount}[i])*K;$$

ΔBD[i] signifying said energizing duration differential to be added to said current energizing duration for an injector i;

MW representing said mean value calculated from said differential amounts of said amounts of the harmonic of the $0.5^{th}$ order assigned to said injectors;

Δ amount[i] representing said determined differential amount for said injector i; and K being a constant.

6. The method according to claim 5, wherein:

said formula being used under condition $\Sigma\Delta BD[i]=0$.

7. The method according to claim 6, wherein:

said constant K being selected dependent upon a current actual load point of the internal combustion engine.

8. The method according to claim 1, wherein:

at least two iterations of the method are performed; and the method is iterated until said deviation for each said injector no longer exceeds a predetermined threshold value.

9. The method according to claim 1, wherein:

said correction step includes compensating said injectors for the correction of each said injector, so that a measure of performance of the internal combustion engine is not changed due to said correction.

10. An engine control unit for an internal combustion engine, said engine control unit implementing a series of steps, said series of steps comprising:

turning off an injector of said internal combustion engine;

capturing a crank angle signal of said internal combustion engine;

transforming said crank angle signal into a frequency range by way of a discrete Fourier transformation;

capturing and storing an amount of a harmonic of the $0.5^{th}$ order of said Fourier transformation of said crank angle signal;

assigning said amount to said turned off injector;

turning on said turned off injector;

performing the previous steps in a sequential manner for each injector of the internal combustion engine;

creating a mean value of said stored amounts assigned to said injectors; and correcting a control of each said injector based on a deviation of said amount assigned to each said injector from said mean value.

11. A system for adjusting an injection behavior of injectors in an internal combustion engine, comprising:

a switching device designed to selectively turn on and turn off an injector;

a detection device designed to capture a crank angle signal of the internal combustion engine;

a converter designed to transform said crank angle signal into a frequency range by way of discrete Fourier transformation;

a memory device designed to capture and store an amount of the harmonic of the $0.05^{th}$ order of said Fourier transformation of said crank angle signal, and to assign said amount to said injector;

an averaging element designed to calculate a mean value over said amounts from all said injectors as stored in said memory device; and a correction element designed to calculate a deviation from said mean value of said amount assigned to an injector that is to be corrected, and to correct a control of said injector based on said calculated deviation.

* * * * *